US010994161B2

(12) United States Patent
Zimmerman

(10) Patent No.: US 10,994,161 B2
(45) Date of Patent: May 4, 2021

(54) RELEASE DEVICE FOR USE WITH A FALL PROTECTION UNIT HAVING A DEPLOYABLE LIFELINE

(71) Applicant: HONEYWELL INTERNATIONAL INC., Morris Plains, NJ (US)

(72) Inventor: Martin Zimmerman, Morris Plains, NJ (US)

(73) Assignee: Honeywell International Inc., Morris Plains, NJ (US)

( * ) Notice: Subject to any disclaimer, the term of this patent is extended or adjusted under 35 U.S.C. 154(b) by 192 days.

(21) Appl. No.: 16/098,557

(22) PCT Filed: May 3, 2016

(86) PCT No.: PCT/EP2016/059926
§ 371 (c)(1),
(2) Date: Nov. 2, 2018

(87) PCT Pub. No.: WO2017/190772
PCT Pub. Date: Nov. 9, 2017

(65) Prior Publication Data

US 2019/0143158 A1 May 16, 2019

(51) Int. Cl.
*A62B 35/00* (2006.01)
*A62B 1/10* (2006.01)

(52) U.S. Cl.
CPC ..... *A62B 35/0093* (2013.01); *A62B 1/10* (2013.01); *A62B 35/0075* (2013.01)

(58) Field of Classification Search
CPC .... A62B 1/00; A62B 1/10; A62B 1/16; A62B 35/0075
See application file for complete search history.

(56) References Cited

U.S. PATENT DOCUMENTS 2,205,026 A * 6/1940 Barham ..... A62B 1/10 182/235
2,479,459 A * 8/1949 Bassett ..... A62B 1/10 182/234

(Continued)

OTHER PUBLICATIONS

International Search Report and Written Opinion for Application No. PCT/EP2016/059926 dated Jan. 10, 2017.

(Continued)

*Primary Examiner* — Alvin C Chin-Shue
*Assistant Examiner* — Candace L Bradford
(74) *Attorney, Agent, or Firm* — Alston & Bird LLP

(57) ABSTRACT

A release device (10) is provided for use with a fall protection unit (12) having a lifeline (14) that can be deployed N in a fall direction to protect a worker (16) in a fall event, and includes a frame (22) configured to fix the release device (10) to a fall protection unit (12), a release member (24) mounted for movement from a lock position to a release position, a connection member (26) configured to connect the deployable lifeline (14) of the fall protection unit (12) to another piece of fall protection equipment connected to the worker (16), the connection member (26) having a locked condition wherein the connection member (26) is prevented from moving in a fall direction relative to the frame (22) and a released condition wherein the connection member (26) is free to move in the fall direction relative to the frame (22); the connection member (26) having a stop surface (34); and a stop link (28) mounted to the frame (22) to move from a engaged position to a disengaged position in response to the release member (24) moving from the lock position to the release position. The stop link (28) has a hold surface (38) engaged with the stop surface (34) with the stop link (28) in the engaged position and the connection member (26) in the locked condition, and at least one of the stop surface (34) and the hold surface (38) area planar surface extending at an (Continued)

acute angle to the fall direction with the connection member (26) in the locked condition and the stop link (28) in the engaged position.

12 Claims, 5 Drawing Sheets

(56) References Cited

U.S. PATENT DOCUMENTS

| | | | | |
|---|---|---|---|---|
| 4,941,548 | A * | 7/1990 | Blanchard | A62B 1/10 182/234 |
| 9,827,451 | B2 * | 11/2017 | Renton | A62B 35/04 |
| 9,884,211 | B2 * | 2/2018 | Hirst | A62B 35/0056 |
| 10,688,323 | B2 * | 6/2020 | Wolner | A62B 1/10 |
| 2008/0142296 | A1 * | 6/2008 | Jean | B66D 5/04 182/5 |
| 2009/0173578 | A1 * | 7/2009 | Renton | A62B 35/0037 182/235 |
| 2019/0209877 | A1 * | 7/2019 | Farrell | B65H 75/4431 |

OTHER PUBLICATIONS

Communication pursuant to Rules 161 (1) and 162 for European Application No. 16721147.3, dated Dec. 13, 2018, 3 pages.

* cited by examiner

RELEASE DEVICE FOR USE WITH A FALL PROTECTION UNIT HAVING A DEPLOYABLE LIFELINE

FIELD

This disclosure relates to fall protection equipment, and more particularly, to a release device for use with a fall protection unit having a lifeline that can be deployed in a fall direction to protect a worker during a fall event, such as, for example, an Anchorage Rescue Device (ARD) which serves as a rescue device for workers which are hanging in free space after a fall event and allows for the worker to be safely descended to the ground by controlled deployment of the lifeline.

BACKGROUND

Fall protection equipment is well known for protecting a worker during a fall event by connecting a worker to an anchor point and absorbing the loads of the fall without allowing a worker to impact the ground or any other lower surface. Problems can arise after a fall event because the worker can become seriously injured if the worker is left suspended in the air for too long a period due to the constriction put on a worker's body by the fall harness. Accordingly, it is important that a worker be rescued as soon as possible after a fall event that leaves a worker suspended in free space. One type of fall protection device/equipment that can allow a worker to be safely rescued is a so-called Anchorage Rescue Device (ARD) which contains a length of lifeline that can be deployed in a controlled manner after a worker has experienced a fall event. One challenge for ARDs is that a release device is needed to allow the lifeline to be deployed after a fall event while a worker's full weight is being supported by the ARD. Accordingly, there is a need for such release devices. Furthermore, it would be beneficial if such release devices could allow either a manual release by a rescuer who has physical access to the ARD unit or a remote release by a rescuer who is positioned remote from the ARD unit and cannot physically access the ARD unit.

Published patent application US 2009/0173578 A1, published Jul. 9, 2009 discloses a fall protection unit having a deployable lifeline (21) and both manual and remote means are alternatively provided for actuating deployment of the lifeline (21). In this regard, the device utilizes a rotating cam pin (14) having a cylindrical surface that engages a cylindrical surface on a connecting member (11) to hold the connecting member 11 in a locked condition. The cam pin (14) can be rotated to expose a clearance cut (18) on the cam pin (14) that allows the connecting member (11) and the lifeline (21) to be deployed from the unit.

SUMMARY

In accordance with one feature of this disclosure, a release device is provided for use with a fall protection unit having a lifeline that can be deployed in a fall direction to protect a worker in a fall event. The release device includes a frame configured to fix the release device to a fall protection unit, a release member mounted for movement from a lock position to a release position, a connection member configured to connect a deployable lifeline of a fall protection unit to another piece of fall protection equipment connected to a worker to transfer loads generated by a worker fall event. The connection member has a locked condition wherein the connection member is prevented from moving in a fall direction relative to the frame and a released condition wherein the connection member is free to move in the fall direction relative to the frame. The connection member has a stop surface. The device further includes a stop link mounted to the frame to move from an engaged position to a disengaged position in response to the release member moving from the lock position to the release position. The stop link has a hold surface engaged with the stop surface with the stop link in the engaged position and the connection member in the locked condition. The stop link is moved away from the connection member and the hold surface is disengaged from the stop surface with the stop link in the disengaged position. At least one of the stop surface and the hold surface is a planar surface extending at an acute angle to the fall direction with the connection member in the locked condition and the stop link in the engaged position.

As one feature, both the stop surface and the hold surface are planar surfaces that extend parallel to each other at an acute angle to the fall direction with the connection member in the locked condition and the stop link in the engaged position.

In one feature, the release member is mounted in the frame to translate between the lock position and the release position.

According to one feature, the release device further includes a linkage connected to the stop link to guide the stop link from the engaged position to the disengaged position in response to the release member moving from the lock position to the release position.

As one feature, the linkage includes a guide link and a slide link. The guide link is pivot mounted to the frame at a first location on the guide link and pivot mounted to the stop link at a second location on the guide link spaced from the first location. The slide link has a first portion pivot mounted to at least one of the guide link and the stop link and a second portion spaced from the first portion and mounted to translate relative to the frame. The release member is engaged against the slide link with the release member in the lock position and the stop link in the engaged position to prevent translation of the second portion relative to the frame. The release member is disengaged from the slide link with the release member in the release position to allow the second portion to translate relative to the frame.

According to one feature, the first portion is pivot mounted to the guide link at the second location.

As one feature, the guide link extends at an acute angle relative to the fall direction, and the slide link extends at another acute angle relative to the fall direction with the connection member in the locked condition and the stop link in the engaged position.

In one feature, the second portion engages a planar surface on the frame and a planar surface on the release member that extends perpendicular to the planar surface on the frame.

According to one feature, the planar surface on the frame extends parallel to the fall direction.

As one feature, the stop surface is defined in a recess formed in the connection member, and a portion of the stop link defines the hold surface and extends into the recess with the stop link in the engaged position and the connection member in the locked condition. The portion of the stop link is withdrawn from the recess as the stop link moves from the engaged position to the disengaged position.

In one feature, the connection member includes an additional stop surface located on a side of the connection member opposite from the stop link, and the release device further includes an additional hold surface engaged with the additional stop surface.

According to an additional feature, an additional release member is mounted in the frame for movement from a lock position to a release position, an additional stop link defines the additional stop surface and is mounted to the frame to move from an engaged position to a disengaged position in response to the additional release member moving from the lock position to the release position. The additional hold surface is engaged with the additional stop surface with the additional stop link in the engaged position and the connection member in the locked condition. The additional stop link is moved away from the connection member and the additional hold surface disengaged from the additional stop surface with the additional stop link in the disengaged position. At least one of the additional stop surface and the additional hold surface is a planar surface extending at an acute angle to the fall direction with the connection member in the locked condition and the additional stop link in the engaged position. An additional linkage is connected to the additional stop link to guide the additional stop link from the engaged position to the disengaged position in response to the additional release member moving from the lock position to the release position.

As one feature, a remote controlled actuator is operably connected to the release member to actuate the release member from the lock position to the release position in response to a signal.

In one feature, the release member includes a manual grip configured to be griped by a user's hand to manually actuate the release member from the lock position to the release position.

According to one feature, the release device is combined with a fall protection unit having a lifeline that can be deployed in the fall direction to protect a worker during a fall event.

It should be understood that a release device according to this disclosure may be provided having any one of the above features or any combination of the above features.

Other features and advantages will become apparent from a review of the entire specification, including the appended claims and drawings.

DETAILED DESCRIPTION

Figure 3:
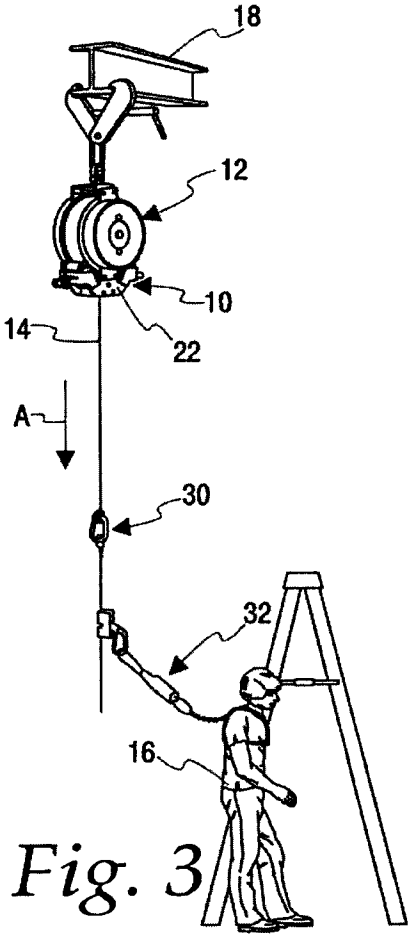
FIGS. 1-3 are somewhat diagrammatic perspective views showing an Anchorage Rescue Device (ARD) utilizing a release device according to this disclosure as is used by a worker during a fall event, with FIG. 1 showing the worker before the fall event, FIG. 2 showing the worker suspended after the fall event together with a potential rescuer, and FIG. 3 showing the worker safely lowered to the ground by the Anchorage Rescue Device and release device according to this disclosure.
Figure 2:
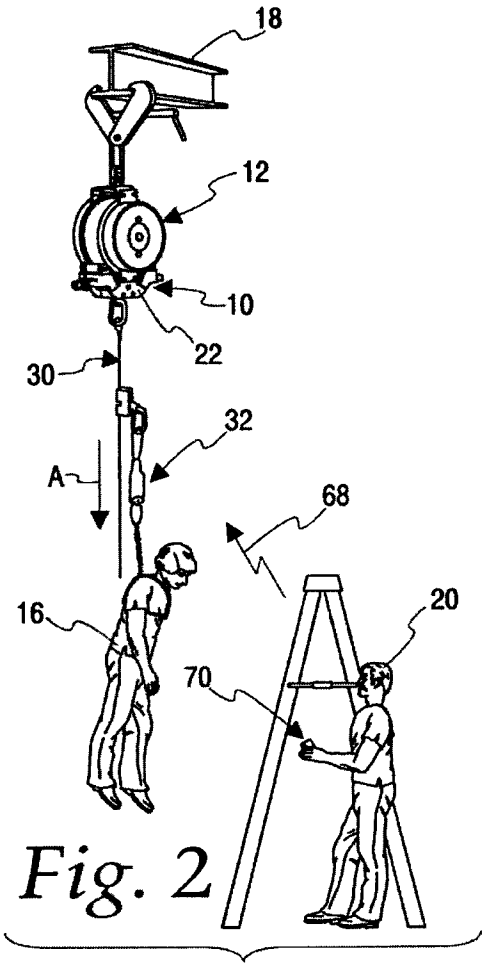
Figure 1:
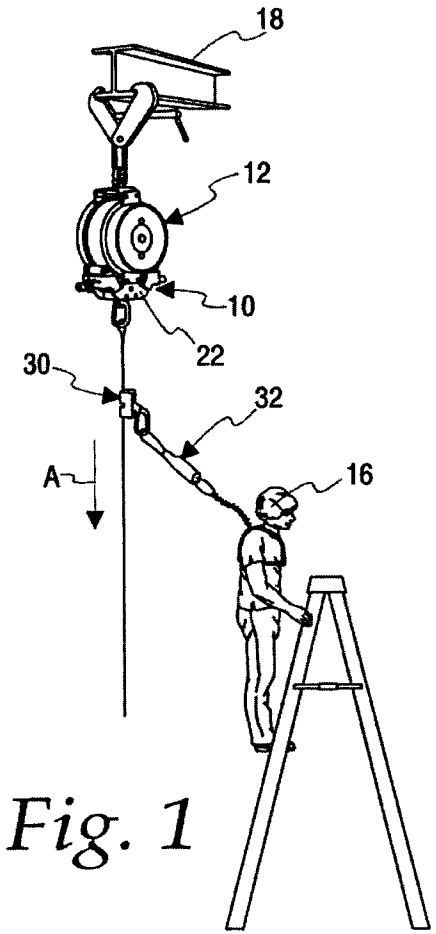
Figure 5:
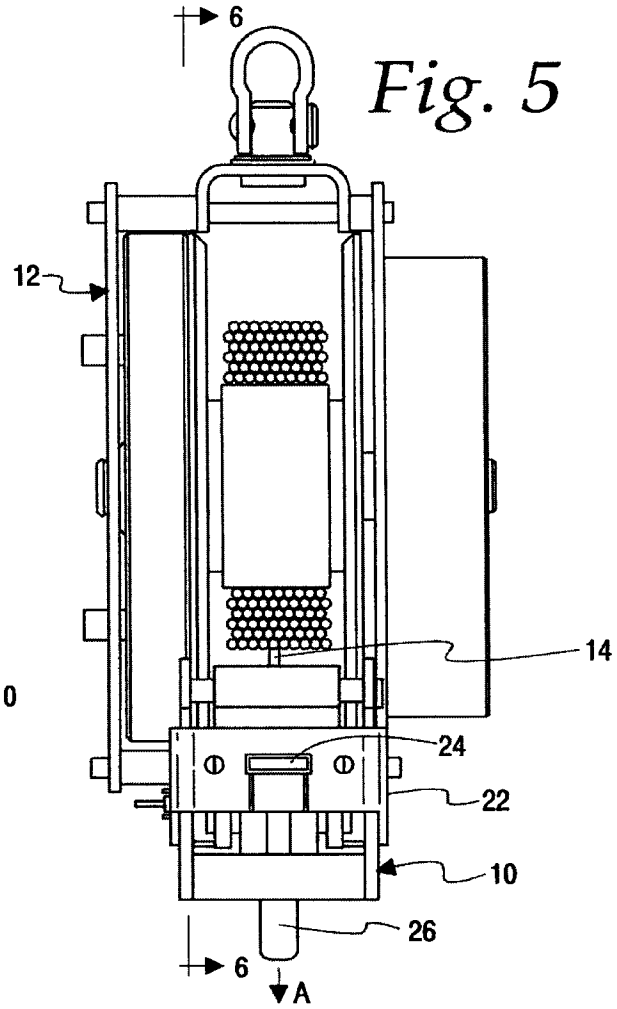
FIG. 5 is a side elevational view of the devices taken from line 5-5 in FIG. 4.
Figure 4:
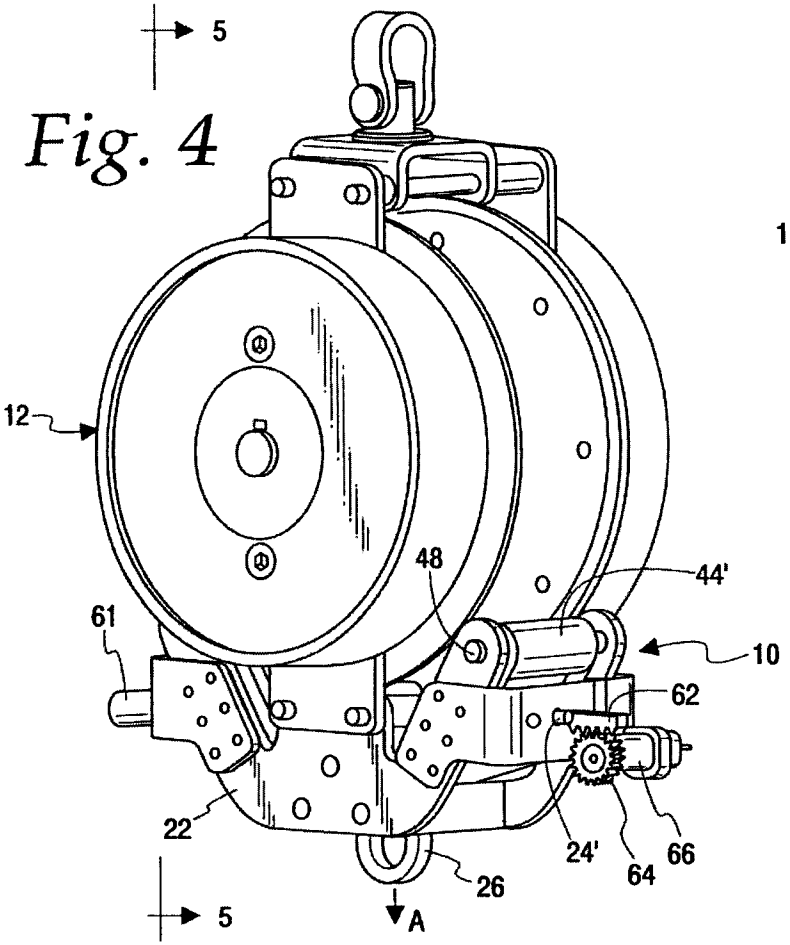
FIG. 4 is an isometric view of the Anchorage Rescue Device in combination with the release device according to this disclosure.

As best seen in FIGS. 1-3, a release device 10 is provided for use with a fall protection unit 12, shown in the form of an anchorage rescue device (ARD) 12 having a lifeline 14 that can be deployed to protect a worker 16 after a fall event in a fall direction, shown by the arrow "A" in FIGS. 1-3, that typically will be the vertical downward direction defined by the force of gravity. It should be noted that for purposes of illustration, the release device 10 and ARD 12 are shown oversized with respect to the worker 16 in FIGS. 1-3. Typically, the fall protection unit 12 will be anchored to some sort of rigid structure, such as the I-beam 18 shown in FIGS. 1-3. The release device 10 is configured to selectively allow the lifeline 14 to be deployed from the fall protection unit 12 after the worker 16 has experienced a fall event and is left suspended in the air, as shown in FIGS. 2 and 3. In the illustrated embodiments, the release device 10 is configured to allow either a remote release of the lifeline 14 by the worker 16 or by a rescuer, such as another worker 20, or for a rescuer to manually release the lifeline if the rescuer 20 has physical access to the release device 10.

Figure 6:
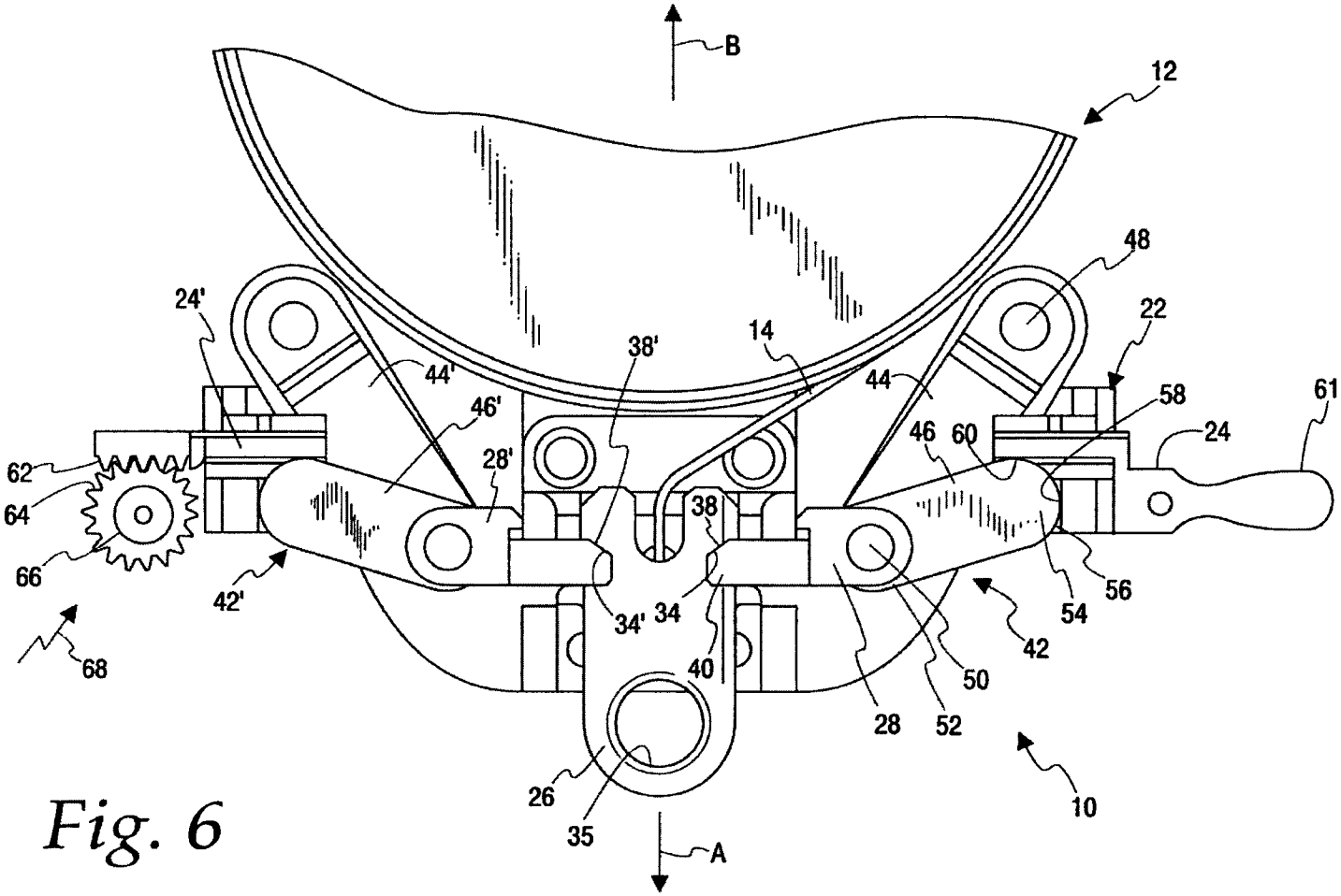
FIG. 6 is an enlarged, partial view taken generally along line 6-6 in FIG. 5, showing the release device in a locked condition.
Figure 7:
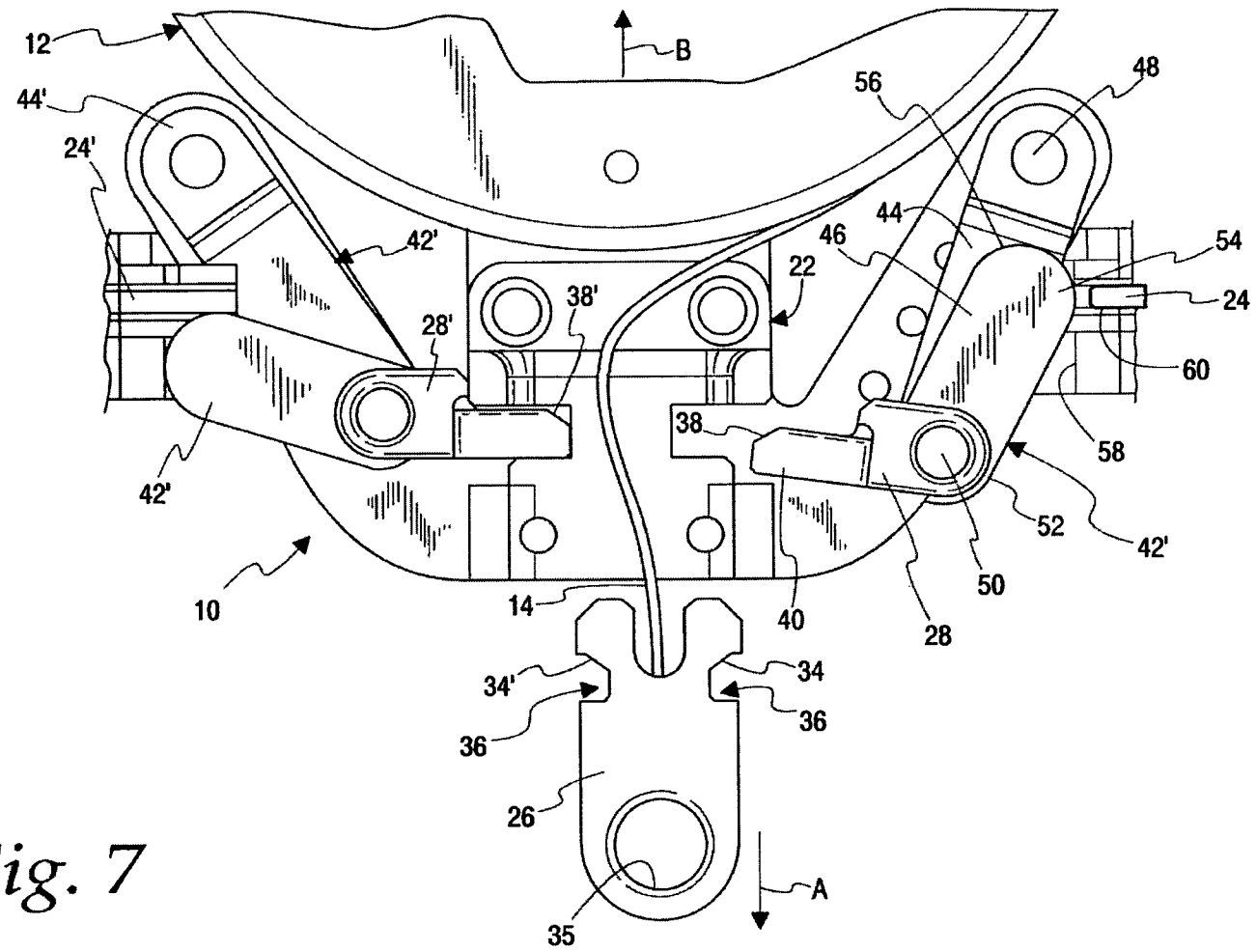
FIG. 7 is a view similar to FIG. 6 but showing the release device in a released condition.
Figure 8:
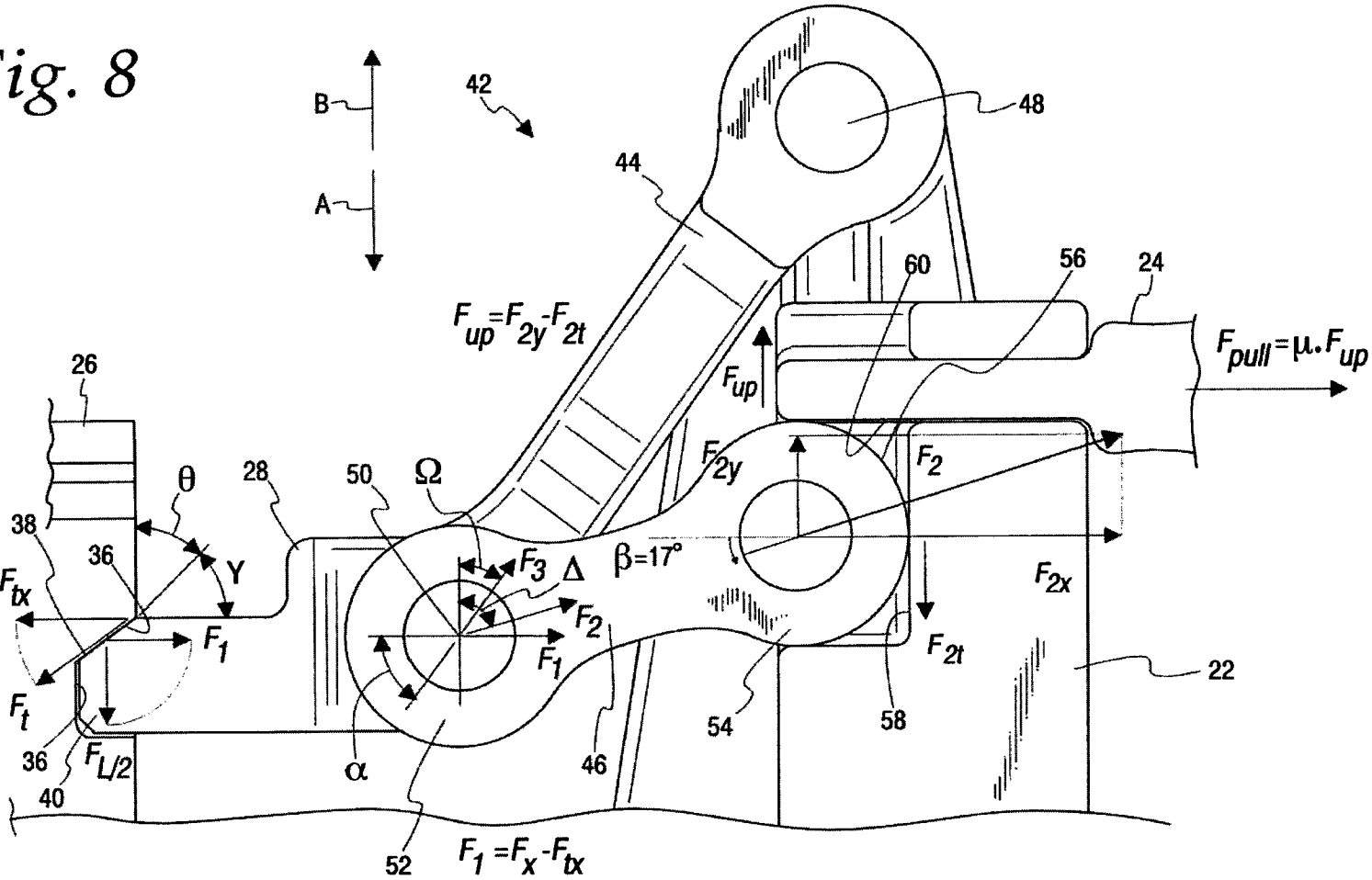
FIG. 8 is an enlarged, somewhat diagrammatic view of selected components from FIGS. 6 and 7 illustrating some of the forces applied to those components.

As best seen in FIGS. 6 and 7, the release device 10 includes a frame 22, a release member 24, a connection member 26, and a stop link 28. The frame 22 is configured to fix the release device 10 to the fall protection unit 12. The release member 24 is mounted for movement (lateral translation in the illustrated embodiment) from a lock position (shown in FIGS. 6 and 8) to a release position (shown in FIG. 7). The connection member 26 is configured to connect the lifeline 14 of the fall protection unit 12 to another piece of fall protection equipment, such as the rope grab system 30 and shock absorbing lanyard 32 shown in FIGS. 1-3, to a worker, such as the worker 16 shown in FIGS. 1-3, to transfer the loads generated by a worker fall event from the worker 16 to the fall protection unit 12. The connection member 26 has a locked condition (shown in FIGS. 1-6 and 8) wherein the connection member 14 is prevented from moving in the fall direction relative to the frame 22 and the fall protection unit 12, and a released condition (shown in FIG. 7) wherein the connection member 26 is free to move in the fall direction relative to the frame 22 and the fall protection unit 12. As best seen in FIG. 8, the connection member 26 includes a stop surface 34 that extends at an acute angle θ relative to fall direction, and a connection feature 35 in the form of an opening 35 that can receive a connector (such as a carabineer) of another piece of fall protection equipment, such as the rope grab system 30 or the lanyard 32. In the illustrated embodiment, the stop surface 34 is defined in a recess 36 (best seen in FIG. 7) formed in the connection member 26. The stop link 28 is mounted to the frame 22 to move from an engaged position (shown in FIGS. 6 and 8) to a disengaged position (shown in FIG. 7) in response to the release member 24 moving from the lock position (shown in FIGS. 6 and 8) to the release position (shown in FIG. 7). The stop link 28 has a hold surface 38 engaged with the stop surface 34 with the stop link 28 in the engaged position and the connection member 26 in the locked condition. In the illustrated embodiment, the hold surface 38 is also a planar surface and extends at the acute angle θ parallel to the stop surface 34 with the stop link 28 in the engaged position and the connection member 26 in the locked condition, and is defined on an end portion 40 of the stop link 28 that is received within the recess 36 of the connection member 26. The stop link 28 is moved away from the connection member 26 and the hold surface 38 is disengaged from the stop surface 34 with the stop link 28 in the disengaged position, as seen in FIG. 7. While both the stop surface 34 and the hold surface 38 are shown as being planar surfaces that extend at the acute angle θ to the fall direction with the connection member 26 in the locked condition and the stop link 28 in the engaged position, in some applications it may be desirable for only one of the surfaces 34 and 38 to be planar and/or to extend at the acute angle θ.

The release device 10 further includes a linkage 42 connected to the stop link 28 to guide the stop link 28 from the engaged position to the disengaged position in response to the release member 24 moving from the lock position to the release position. The linkage 42 includes a guide link 44 and a slide link 46. The guide link 44 is pivot mounted to the frame 22 at a first location 48 on the guide link 44, and pivot mounted to the stop link 28 at a second location 50 on the guide link 44 that is spaced from the first location 48 on the guide link 44. The slide link 46 has a first portion 52 mounted to at least one of the guide link 44 and the stop link 28, and a second portion 54 spaced from the first portion 52 and mounted for frictional translation relative to the frame 22. In the illustrated embodiment, the slide link 46 is pivot mounted to both the stop link 28 and the guide link 44 at the second location 50, and is mounted to translate in the vertical upward direction (shown by the arrow "B") relative to the frame 22 via a sliding frictional engagement between a cylindrical surface 56 on the second portion 54 and a planar, vertically extending surface 58 on the frame 22.

The release member 24 is engaged against the slide link 46 with the release member 24 in the lock position and the stop link 28 in the engaged position to prevent translation of the second portion 54 of the slide link 46 relative to the frame 22. In the illustrated embodiment, the cylindrical surface 56 of the second portion 54 of the slide link 46 engages against a planar surface 60 of the release member 24 that extends perpendicular to the fall direction. The release member 24 is disengaged from the slide link 46 as the release member 24 is moved from the lock position to the release position to allow the second portion 54 of the slide link 46 to translate relative to the frame 22. As best seen in FIG. 8, the guide link 44 extends at an acute angle Ω relative to the fall direction, and the slide link extends at an acute angle Δ relative to the fall direction with the stop link 28 in the engaged position and the connection member 26 in the locked condition.

The arrangement of the linkages 28, 44 and 46 allows for the release member 24 to be actuated from the lock position to a release position by a force $F_{pull}$ that is significantly lower (two orders of magnitude lower in the illustrated embodiment) than the force applied to the release device 10 by a worker 16 suspended from the connection member 26. In this regard, for the illustrated embodiment and with reference to FIG. 8, the force $F_{pull}$ required to actuate the release member 24 from the lock position to the release position can be derived from the following set of calculations shown in the following example, which uses specific loads and angles to illustrate one advantageous configuration:

| | |
|---|---|
| Max. load (total weight of worker 16) | $F_L = 160$ kg |
| Gravitational acceleration | $g = 9.807\ \frac{m}{s^2}$ |
| Angle $\alpha$ | $\alpha = 55$ deg |
| Angle $\beta$ | $\beta = 17$ deg |
| Angle $\gamma$ | $\gamma = 36$ deg |
| Friction coefficient steel-steel | $\mu = 0.2$ |

$$F_x = 0.5\ g \cdot F_L \cdot \tan(\gamma) = 569.996\ N$$

$$F_t = \mu\ (0.5 \cdot F_L \cdot \cos(\gamma)) = 126.94\ N$$

$$F_{tx} = \cos(\gamma) \cdot F_t = 102.697\ N$$

$$F_1 = F_x - F_{tx} = 467.299\ N$$

$$\frac{F1}{\sin[2\pi - \beta - (2\pi - \alpha)]} = \frac{F2}{\sin(2\pi - \alpha)} = \frac{F3}{\sin(\beta}$$

$$\left| F_{2=\frac{F_1 \cdot sin(2\pi-\alpha)}{sin[2\pi-\beta-(2\pi-\alpha)]}} \right| = 621.753\ N$$

$$F_{2x} = \cos(\beta) \cdot F_2 = 594.585\ N$$

$$F_{2y} = \sin(\beta) \cdot F_2 = 181.783\ N$$

$$F_{2t} = \mu \cdot F_{2x} = 118.917\ N$$

$$F_{up} = F_{2y} - F_{2t} = 62.866\ N$$

$$F_{pull} = \mu \cdot F_{up} = 12.573\ N$$

As best seen in FIG. 6, in the illustrated embodiment, the release device 10 includes an additional release member 24', an additional stop link 28', and an additional linkage 42' including an additional guide link 44' and an additional slide link 46', all located on the opposite side of the connection member 26 from the links 28, 44 and 46, with the stop link 24', guide link 44' and slide link 46' being a mirror image arrangement of the stop link 28, guide link 44 and slide link 46 and operating in the same fashion as previously described from the links 28, 44 and 46.

The release member 24 in the illustrated embodiment includes a manual grip 61 that is configured to be gripped by a rescuer's/user's hand to manually actuate the release member 24 from the locked position to the released position. The release member 24' includes a toothed rack 62 that engages a pinion 64 of a remote controlled electric actuator 66 that is configured to rotate the pinion 64 to drive the toothed rack 62 to the left, thereby actuating the release member 24' from the locked position to the released position in response to a wireless signal 68 from a remotely located user/rescuer 20. In this regard, the remote controlled actuator 66 will include suitable control circuitry and a wireless receiver that are activated by the wireless signal 68 using any suitable wireless protocol, many of which are known, which is transmitted from a wireless transmitter in a suitable remote device 70, many of which are known, carried by a remotely located user/rescuer 20, as best seen in FIG. 2, or carried by the suspended worker 16.

While the remote controlled actuator 66 has been shown in the form of an electric motor driving a pinion 64, it should be appreciated that any suitable linear actuator can be used to translate the release member 24' of the illustrated embodiments from the lock position to the release position. For example, any suitable pressure cylinder type linear actuator can be used, including such actuators that are activated via an air charge or via a small explosive charge that pressurize the cylinder in response to the wireless signal 68. It should also be appreciated that while the disclosed embodiments show stop links 28, 28' and linkages 42, 42' and release members 24, 24' on each side of the connection member 26, in many application it will be desirable to have a stop link 24, linkage 42 and release member 24 on only one side of the connection member 26, with the opposite side of the connection member either including a stop surface 34' engaged with a stationary hold surface 38', or simply having a vertical surface that slidingly engages a corresponding vertical surface on the frame 22. Furthermore, in such arrangements, it may be desirable for the single release member 24 to include both the manual grip 61 and a remote controlled actuator 66 of any suitable type to allow both options for moving the single release member 24 from the lock position to the release position. It should further be appreciated that while the disclosed embodiment shows specific geometries and shapes for each of the components and the arrangement of the components relative to each other, other geometric shapes and arrangements may be desirable in some applications. Accordingly, no limitations are intended unless express recited in one of the appended claims.

It should be appreciated that the release device 10 of this disclosure allows for the lifeline 14 of a fall protection unit 12 to be released while under load from a worker 16 that has experienced a fall event, with the force required to release the lifeline being significantly lower than the load applied to the lifeline 14 by the suspended worker 16. If should further be appreciated that the release device 10 can be configured to allow for manual release, remote release, or both manual and remote release. It should additionally be appreciated that the release device provides its desired function with very few moving components and with components that are robust and simple to manufacture.

The invention claimed is:

1. A release device for use with a fall protection unit having a lifeline that can be deployed in a fall direction to protect a worker in a fall event, the release device comprising:

a frame configured to fix the release device to the fall protection unit;

a release member mounted for movement from a lock position to a release position;

a connection member configured to connect a deployable lifeline of the fall protection unit to another piece of fall protection equipment connected to the worker to transfer loads generated by a worker fall event, the connection member having a locked condition wherein the connection member is prevented from moving in the fall direction relative to the frame and a released condition wherein the connection member is free to move in the fall direction relative to the frame; the connection member having a stop surface; and a stop link mounted to the frame to move from a engaged position to a disengaged position in response to the release member moving from the lock position to the release position, the stop link having a hold surface engaged with the stop surface with the stop link in the engaged position and the connection member in the locked condition, the stop link moved away from the connection member and the hold surface disengaged from the stop surface with the stop link in the disengaged position; at least one of the stop surface and the hold surface being a planar surface extending at an acute angle to the fall direction with the connection member in the locked condition and the stop link in the engaged position;

a linkage connected to the stop link to guide the stop link from the engaged position to the disengaged position in response to the release member moving from the lock position to the release position, wherein the linkage comprises a guide link pivot mounted to the frame at a first location on the guide link and pivot mounted to the stop link at a second location on the guide link spaced from the first location; and a slide link having a first portion pivot mounted to at least one of the guide link and the stop link and a second portion spaced from the first portion and mounted to translate relative to the frame, and wherein:

the release member is engaged against the slide link with the release member in the lock position and the stop link in the engaged position to prevent translation of the second portion relative to the frame, and the release member is disengaged from the slide link with the release member in the release position to allow the second portion to translate relative to the frame.

2. The release device of claim 1 wherein both the stop surface and the hold surface are planar surfaces that extend parallel to each other at the acute angle to the fall direction with the connection member in the locked condition and the stop link in the engaged position.

3. The release device of claim 1 wherein the release member is mounted in the frame to translate between the lock position and the release position.

4. The release device of claim 1 wherein the first portion is pivot mounted to the guide link at the second location.

5. The release device of claim 1 wherein the guide link extends at the acute angle relative to the fall direction, and the slide link extends at another acute angle relative to the fall direction.

6. The release device claim 1 wherein the second portion engages a planar surface on the frame and the planar surface on the release member that extends perpendicular to the planar surface on the frame.

7. The release device of claim 6 wherein the planar surface on the frame extends parallel to the fall direction.

8. The release device of claim 1 wherein the stop surface is defined in a recess formed in the connection member and a portion of the stop link defining the hold surface extends into the recess with the stop link in the engaged position and the connection member in the locked condition; and wherein the portion of the stop link is withdrawn from the recess as the stop link moves from the engaged position to the disengaged position.

9. A release device for use with a fall protection unit having a lifeline that can be deployed in a fall direction to protect a worker in a fall event, the release device comprising:

a frame configured to fix the release device to the fall protection unit;

a release member mounted for movement from a lock position to a release position;

a connection member configured to connect a deployable lifeline of the fall protection unit to another piece of fall protection equipment connected to the worker to transfer loads generated by a worker fall event, the connection member having a locked condition wherein the connection member is prevented from moving in the fall direction relative to the frame and a released condition wherein the connection member is free to move in the fall direction relative to the frame; the connection member having a stop surface;

a stop link mounted to the frame to move from a engaged position to a disengaged position in response to the release member moving from the lock position to the release position, the stop link having a hold surface engaged with the stop surface with the stop link in the engaged position and the connection member in the locked condition, the stop link moved away from the connection member and the hold surface disengaged from the stop surface with the stop link in the disengaged position; at least one of the stop surface and the hold surface being a planar surface extending at an acute angle to the fall direction with the connection member in the locked condition and the stop link in the engaged position, wherein the connection member comprises an additional stop surface located on a side of the connection member opposite from the stop link; and wherein the release device further comprises an additional hold surface engaged with the additional stop surface;

an additional release member mounted in the frame for movement from the lock position to the release position;

an additional stop link defining the additional stop surface and mounted to the frame to move from the engaged position to the disengaged position in response to the additional release member moving from the lock position to the release position, the additional hold surface engaged with the additional stop surface with the additional stop link in the engaged position and the connection member in the locked condition, the additional stop link moved away from the connection member and the additional hold surface disengaged from the additional stop surface with the additional stop link in the disengaged position;

at least one of the additional stop surface and the additional hold surface being a planar surface extending at the acute angle to the fall direction with the connection member in the locked condition and the additional stop link in the engaged position; and an additional linkage connected to the additional stop link to guide the additional stop link from the engaged position to the disengaged position in response to the additional release member moving from the lock position to the release position.

10. The release device of claim 9 further comprising a remote controlled actuator operable connected to the release member to actuate the release member from the lock position to the release position in response to a signal.

11. The release device of claim 9 where the release member comprises a manual grip configured to be gripped by a user's hand to manually actuate the release member from the lock position to the release position.

12. The release device of claim 9 in combination with the fall protection unit having the lifeline that can be deployed in the fall direction to protect the worker (16) during the fall event.

* * * * *